United States Patent [19]

Holt et al.

[11] Patent Number: 4,597,396

[45] Date of Patent: Jul. 1, 1986

[54] FARMER'S BALE DELAMINATOR

[75] Inventors: Dewey L. Holt; Benjamin F. Reynolds, both of Winston-Salem, N.C.

[73] Assignee: R. J. Reynolds Tobacco Company, Winston-Salem, N.C.

[21] Appl. No.: 462,262

[22] Filed: Jan. 31, 1983

[51] Int. Cl.[4] ..... A24B 1/00; A24B 3/00

[52] U.S. Cl. ..... 131/327; 131/290

[58] Field of Search ..... 131/316-318, 131/327, 304, 306, 290, 313-315, 322; 19/86, 96, 97.5, 83

[56] References Cited

U.S. PATENT DOCUMENTS

| | | | |
|---|---|---|---|
| 2,275,103 | 3/1942 | Gooch, Jr. et al. | 131/117 |
| 3,357,437 | 2/1966 | Maguire | 131/304 |
| 3,903,901 | 9/1975 | Wochnowski | 131/108 |
| 4,035,869 | 7/1977 | Wilkes et al. | 19/97.5 |
| 4,222,397 | 9/1980 | Brackmann et al. | 131/306 |
| 4,349,037 | 9/1982 | Brackmann et al. | 131/306 |
| 4,449,540 | 2/1982 | Marshall et al. | 131/290 |
| 4,456,018 | 6/1984 | Brackmann et al. | 131/117 |

FOREIGN PATENT DOCUMENTS

| | | | |
|---|---|---|---|
| 165983 | 5/1950 | Fed. Rep. of Germany | 131/117 |
| 2052947 | 2/1981 | United Kingdom | 131/118 |
| 2066046 | 7/1981 | United Kingdom | 131/117 |

*Primary Examiner*—V. Millin
*Assistant Examiner*—H. Macey
*Attorney, Agent, or Firm*—Grover M. Myers

[57] ABSTRACT

Apparatus is provided to delaminate farmer's bales of tobacco. The apparatus includes a bed and a delamination chamber and is carried on wheels for portability. Within the delamination chamber, a farmer's bale is gripped by structure which feeds the bale at a uniform, controlled, and selected rate. The structure may include combinations of rollers, belts, or the like. Delamination is accomplished by engaging the bale with a delamination knife in a direction parallel to the lamina and slicing the bale into portions of suitable size for further processing.

10 Claims, 6 Drawing Figures

FARMER'S BALE DELAMINATOR

BACKGROUND OF THE INVENTION

The present invention relates to apparatus for separating compacted masses of vegetable material. More particularly, the invention relates to apparatus for delaminating tobacco compacted into "farmer's bales."

Tobacco marketing in the United States is a highly decentralized process. Typically, individual growers carry their tobacco to a local warehouse, where it is purchased by representatives of tobacco companies. Buyers consolidate their purchases for shipment to manufacturing facilities. Traditionally, consolidation has meant "prizing" the tobacco into hogsheads for shipment and future storage. This operation may take place in the local warehouse, if the warehouse is sufficiently large, but more typically it occurs in a "prize house," a facility devoted solely to that operation serving a number of warehouses in a region.

In the marketing of burley tobacco, two recent developments have upset the traditional pattern. First, buyers increasingly have abandoned the traditional hogshead in favor of the Tersa bale. In contrast to the round, wooden hogshead, the Tersa bale is formed by compressing about 1,100 pounds of tobacco into a cube, which optimizes transportation and storage. The bale is formed in a portable press, which is transported from market to market, and retained in its compressed state by straps. The resulting bale thus is self-supporting, without the necessity of a heavy burlap outer wrapper. A light overwrap, such as netting, may be used to prevent small pieces of tobacco from falling out of the bale.

The second development is the advent of the "farmer's bale" for burley tobacco. Traditionally, burley tobacco has been sold in "baskets," loose stacks of about 200–800 pounds of tobacco. The loose arrangement of the tobacco facilitated compression of several "baskets" into a Tersa bale. Recently, however, burley farmers have begun bringing their tobacco to market in "farmer's bales," as discussed in Duncan & Smiley, "Preparing Burley in Bales" (Univ. of Kentucky 1978). Such bales contain about 90 pounds of tobacco, but the tobacco is pressed into a bale one foot by two feet by three feet. As the tobacco is compressed into a relatively solid cake, these bales are considerably easier for farmers to handle. It is estimated that virtually all burley tobacco will be sold in this form within the near future.

As can be readily appreciated, the relatively solid farmer's bales do not lend themselves to formation of Tersa bales. Although farmer's bales do break down somewhat within the press, large lumps remain. The result is wide variations in density within the Tersa bale. For example, one test of a Tersa bale formed from farmer's bales showed that some portions of the Tersa bale were packed to a density of about ten pounds per cubic foot, while others ranged as high as 36 pounds per cubic foot. This phenomenon leads to poorly compacted Tersa bales. Because the Tersa bale depends upon compression to maintain its shape and integrity, the presence of such wide variations degrades the structural inegrity of the bale. Bales, particularly those upon which other bales are stacked, literally fall apart. When this occurs in shipment or storage, large amounts of tobacco are lost to wastage.

Buyers responded to the initial appearance of farmer's bales by resorting to hand separation of the bales prior to loading tobacco into the press. This solution was acceptable when farmer's bales constituted a small portion of the burley sold; obviously, the increase in usage of farmer's bales has led to the strong need for a mechanized, portable delamination apparatus.

The prior art offers little help in solving the problem of delaminating tightly compressed bales. Primarily, existing devices are directed toward the separation of rather loosely packed masses. For example, U.S. Pat. No. 2,873,747, to Schlossmacher, depends upon separating a tobacco bale by placing it upon an oscillating bed; vibration causes the leaves to separate from the bale. Further leaf separation is accomplished by passing the separated leaves through a succession of spiked wheels, whose spikes pass between sets of stationary spikes. This apparatus fails to solve the existing problem. First, farmer's bales do not fall apart when vibrated. Second, the combination of rotating and stationary spikes does not delaminate the farmer's bale but rather tears the bale into small pieces unacceptable at this stage of the tobacco processing. Also, this apparatus would produce an unacceptably high level of dust and fines. Furthermore, if the apparatus were modified to eliminate the stationary spikes, it was found that the rotating spiked wheel quickly became clogged with tobacco leaves, resulting in unacceptably high down time to clear the spikes. These disadvantages are shared by U.S. Pat. No. 1,328,734, to Harriss, another device using spiked wheels.

Another device, shown in U.S. Pat. No. 3,016,906, to Peters, discloses apparatus for separating tobacco lumps into individual particles by dropping lumps vertically into a chamber in which a plurality of yieldable projections are mounted. Flexing of the yieldable projections separates lumps into individual leaves for further processing. Again, this device is not adaptable to the problem of separating 90-pound bales. The bales simply do not separate readily in such a process.

The problem posed by compacted masses of tobacco can be seen dramatically in U. S. Pat. No. 3,838,698, to Dickenson. The solution presented there requires that a bale be forced onto a hollow probe, which passes moist air or steam into the bale, separating the lamina sufficiently so that tobacco can be separated by doffers. Although such a system may be effective, it also is expensive, requiring a supply of steam and rather cumbersome apparatus. Moreover, it utterly fails to meet the need for portable apparatus which may be transported between geographically dispersed tobacco markets.

Thus, the prior art leaves a tobacco buyer exactly where he started: no practical apparatus exists to eliminate the expensive hand separation of farmer's bales.

SUMMARY OF THE INVENTION

It is, therefore, a broad object of the present invention to provide apparatus for separating compacted masses of vegetable matter into individual components.

It is a further object of this invention to provide apparatus for separating compacted masses of tobacco into lamina.

It is a particular object of the present invention to provide apparatus for delaminating farmer's bales of burley tobacco into lamina which facilitate subsequent formation into Tersa bales.

It is a further object of the present invention to provide apparatus capable of continuously processing a succession of farmer's bales.

It is another object of this invention to provide apparatus for separating farmer's bales which is portable, enabling apparatus to be moved between tobacco markets.

These and other objects are accomplished by the present invention. Broadly, the invention comprises means for gripping and feeding a farmer's bale at a uniform, controlled, selected rate, which feeds a farmer's bale to a delamination means, which slices the bale into lamina. The gripping end feeding means may be a roller or set of rollers operating in parallel, or opposed belts, or other suitable means. The delaminating means may be a set of delaminating knives mounted on a roller, which engage the upper surface of the bale to slice lamina therefrom.

DETAILED DESCRIPTION OF PREFERRED EMBODIMENTS

Figure 1:
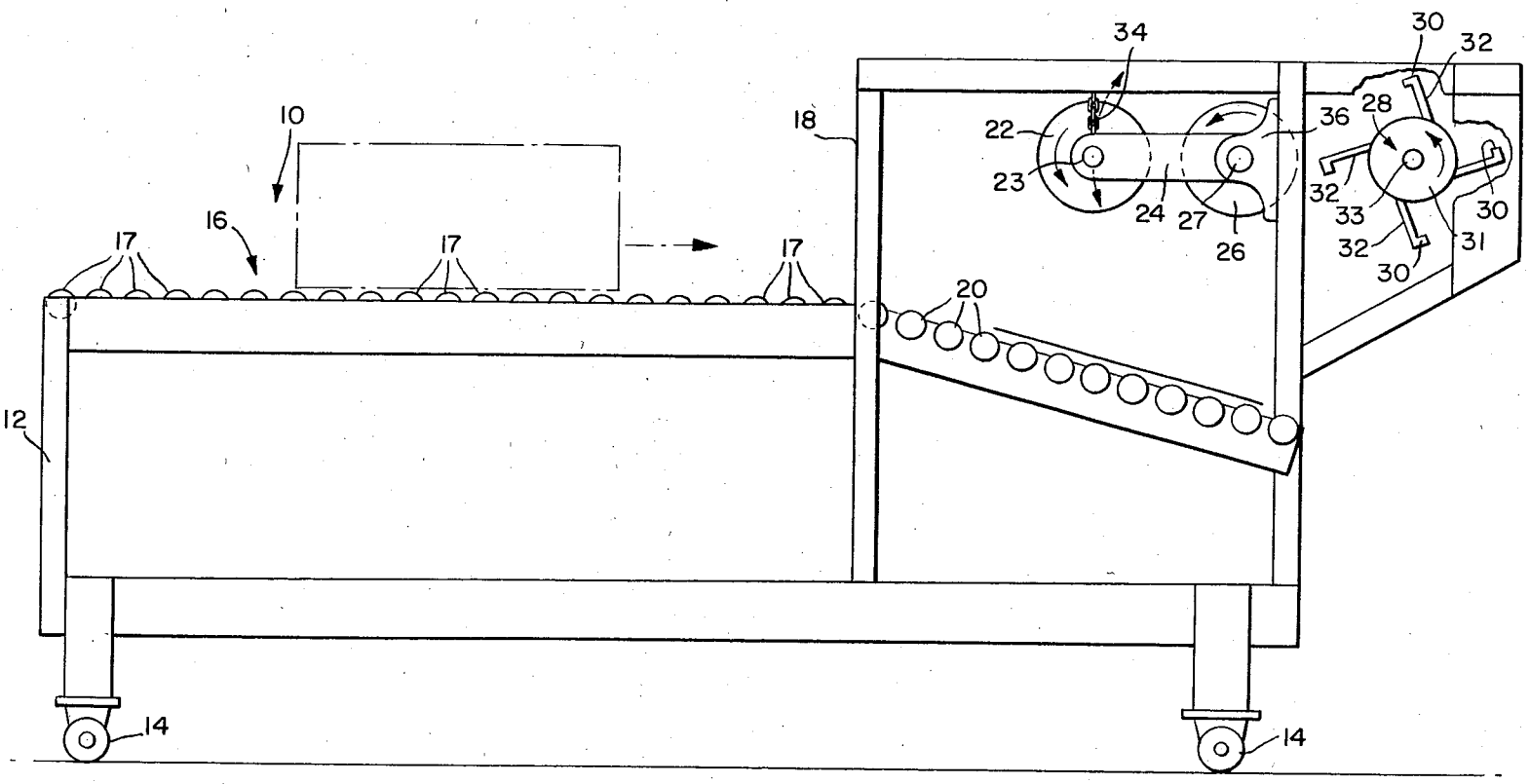
FIG. 1 is a side view of an embodiment of the present invention, with side plates and drive apparatus removed to show the working parts.

An embodiment of the present invention is shown in FIG. 1. For clarity, this embodiment is shown with side panels and drive components removed.

The delaminator apparatus 10 is carried on a frame 12. As shown, the frame is constructed of tubular steel, but it may be fabricated from any convenient material. The frame is carried on wheels 14, conventionally mounted, to facilitate transportation between markets and movement to different positions within a given warehouse or prize house.

One end of the frame comprises an elongated rectangular bed 16, preferably dimensioned to accommodate the two-foot width of farmer's bales. The bed is provided with transverse rollers 17, journaled for free rotation, along its entire length. Any means for facilitating the handling and movement of bales along the bed could be substituted for the rollers, but it has been found that powered apparatus, such as a conveyor belt, impedes preparation of the bales for delamination, as hereinafter discussed.

The remainder of the frame is taken up by the delamination chamber 18. The input end of the chamber lies adjacent the bed, and the output end is located at the end of the apparatus. This chamber is generally rectangular, and dimensioned to accommodate the components discussed below. The chamber is shown without side panels, for clarity, but in operation, it is desirable to provide enclosures at least around the sides of the chamber to minimize tobacco fines around the apparatus. In addition, flexible covers over the receiving and output ends of the apparatus may be provided to serve the same purpose. The delamination chamber floor is shown provided with additional free-rotating rollers 20. The floor slopes downward from the end of the bed to the output and of the delamination chamber. This design has proven advantageous in handling bales, but those skilled in the art could easily modify positioning of the components to provide a level floor.

Three rollers are positioned within the delamination chamber above the floor. A feed roller 26 has outwardly-extending shafts 27 journaled in mounting blocks 36 carried on upright members at the output end of the delamination chamber. Pivoting arms 24 are carried on shaft 27 adjacent the ends of the feed roller and extend from the feed roller toward the input end of the delamination chamber. The other ends of the arms carry a shaft 23, which extends outwardly from pressure roller 22. Limit chains 34 descend from upper horizontal members of the delamination chamber and are attached to the ends of the pivoting arms adjacent the pressure roller. Thus, the pressure roller is free to move vertically, with its descent limited by the limit chain. Both the feed roller and pressure roller are shown fabricated of black iron, covered with pyramid belting. Variations in dimensions and width will be apparent to those skilled in the art. Both rollers are driven, as hereinafter discussed.

Figure 2:
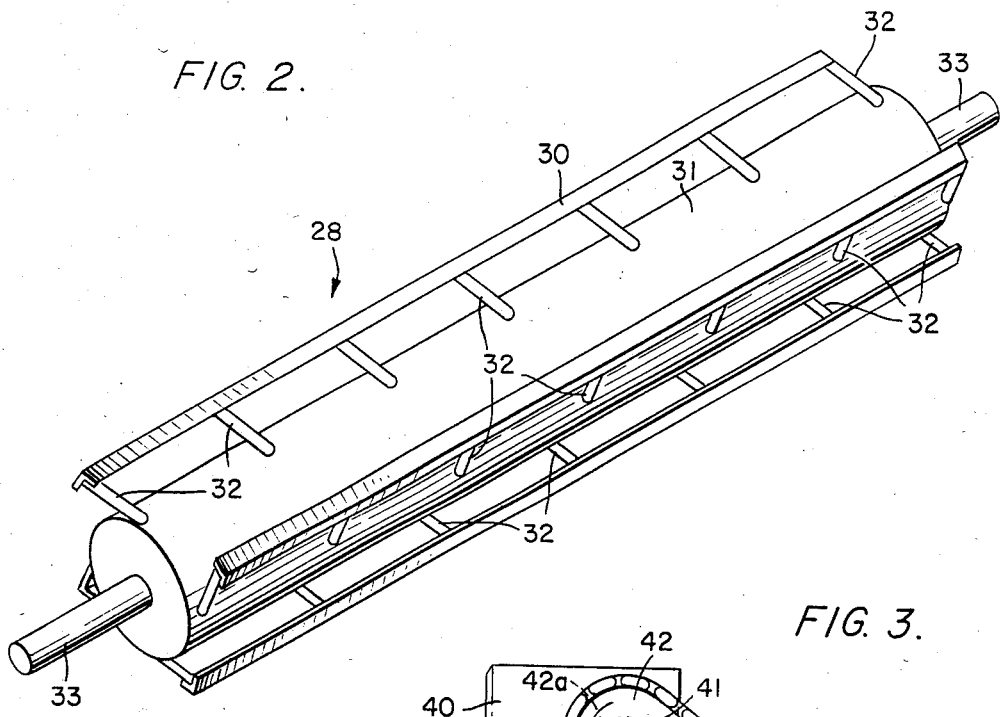
FIG. 2 is a detailed pictorial of the delamination roller.

A delamination roller 28 is positioned adjacent the output end of the delamination chamber. Details of the delamination roller are best seen in FIG. 2. This component is formed on a standard steel pipe roller 31 having a 36 inch face. A shaft 33 extends outwardly from both ends of the roller. Four rows of pins 32 extend outwardly from the roller body, spaced at 90 degree intervals around the roller. The pins do not extend radially outward, but are fixed to the roller body such that their axes describe a tangent to a circle having approximately half the diameter of the roller. Experimentation with different modes of mounting the pins has shown that this arrangement leads to optimum delamination. It is preferred to use half-inch diameter steel pins, extending three inches from the roller face, with seven pins in each row. Constructional and dimensional details may, of course, be varied by those skilled in the art to suit particular circumstances.

A knife 30 is fixed to the ends of the pins in each row, extending the length of the roller face. The knife may be fabricated from any convenient stock, such as the $\frac{1}{4}'' \times \frac{3}{4}''$ angle iron shown. Angle stock is preferred here because it provides a lower cross-sectional impact area, resulting in improved delamination. The projecting leg of the angle should be oriented in the direction of roller rotation.

The three rollers are positioned within the delamination chamber to cooperate in the delamination process. The lower limit of the pressure roller's vertical travel is governed by the limit chain to provide about ten inches clearance between the delamination chamber floor and the pressure roller. This allows the pressure roller to ride up on a bale, exerting pressure by virtue of its weight. Clearance between the delamination chamber floor and the feed roller should be slightly less than twelve inches, so that the pressure roller grips a bale snugly, but does not crush it. The delamination roller is positioned so that about thirty degrees of the rotational arc described by each knife intersects the path described by a forward-moving bale.

Figure 3:
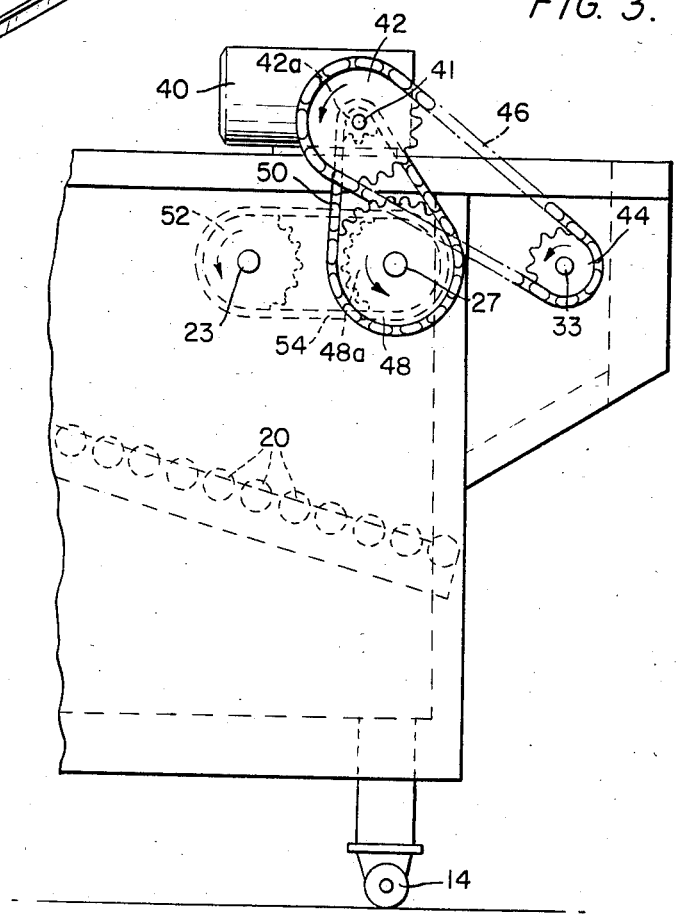
FIG. 3 is a partial side view of the embodiment of FIG. 1, with side plates and drive apparatus mounted.

The drive mechanism for this apparatus is shown in FIG. 3. A power source capable of delivering two horsepower at 100 rpm provides operative power to the apparatus. Preferably, this power source is an electric motor 40 mounted atop the delamination chamber. Two sprockets 42 and 42*a* are fixed to the motor shaft 41. A delamination chain 46 engages drive sprocket 42 and delamination sprocket 44, fixed to the delamination roller shaft 33, to drive the delamination roller. The feed roller chain 50 engages drive sprocket 42*a* and feed roller sprocket 48, fixed to the feed roller shaft 27. A second sprocket 48*a* also is fixed to the feed roller shaft, and is engaged by a chain 54, which also engages pressure sprocket 52, fixed to the pressure roller shaft 23.

Timing of the operation is achieved by careful selection of sprocket ratios. Sprocket sizes are chosen such that when a bale is fed forward at a selected rate, the bale is engaged by a delamination roller knife at selected intervals. Experimentation has revealed that it is desirable to establish a bale feeding rate of 50 feet/minute and to have a delamination knife engage the bale of one inch intervals. In the embodiment shown, these criteria resulted in selected rotation speeds of 50 rpm for the feed roller and pressure roller, and a speed of 200 rpm for the delamination roller. Thus, the combination of sprockets 42 and 44 result in a speed multiplication of two to one from the motor to the delamination roller, and sprockets 42*a* and 48 provide a 1:2 speed reduction from the motor to the feed roller. Sprockets 48*a* and 52 are chosen to provide a 1:1 ratio between the feed and pressure rollers.

The present invention delaminates farmer's bales of tobacco in the following manner. A farmer's bale is placed on the bed 16 with its long axis parallel to the sides of the apparatus. In this position, the bale laminations are upright and transverse to the bed. The operator then removes any twine wrapped around the bale and slides the bale across the rollers 17 into the delamination chamber 18. Inside the chamber, the upper leading edge of the bale makes contact with the pressure roller 22. Because the pressure roller has pivoted downward on arms 24 to the limit of chain 34, the clearance between the delamination chamber floor 20 and the pressure roller is less than the thickness of the bale, so the pressure roller rides up onto the bale, exerting downward pressure on it. Because the pressure roller is rotating counter-clockwise (as viewed from the right side of the apparatus), the bale is urged forward at a selected rate of speed: here, 50 feet/minute. As the bale progresses forward, it is gripped by the feed roller 26, rotating in the same direction and at the same speed as the pressure roller. The combined action of the two rollers holds the bale firmly in position while feeding it forward at the selected rate of speed.

As the bale approaches the output end of the delamination chamber, the upper surface of the bale is engaged by successive delamination roller knives 30. The rotational speed of the delamination roller is such that the bale advances forward about one inch between successive engagements of delamination knives. Because each delamination knife describes a circular path, the bale is subjected to a force having both vertical and horizontal components. The vertical component is parallel to the layers of which the bale is composed, and it thus tends to separate the bale into lamina. The horizontal component produces a pulling effect, which accelerates the separation of lamina from the body of the bale. Because the delamination knife is traveling faster than the bale, lamina are impelled away from the bale toward the output area of the delaminator. A conveyor or other transporting means may be provided under the delaminator output area to carry tobacco lamina to a press for compaction into Tersa bales.

Two factors seem important to achieving the results described. First, it is necessary to move the bale toward the delamination roller at a uniform, controlled, and selected rate. Uniformity is important so that the resulting lamina will be of a proper size to facilitate subsequent compaction into a Tersa bale. Also, if the knife strikes the upper surface of the bale too close to the leading edge, excessive fines will be produced. Control, provided by the pressure exerted by the pressure and feed rollers on the top of the bale, is necessary to prevent the action of the delamination knife itself from affecting the forward speed of the bale. Selection of the bale's forward speed is critical, as it has been discovered that if the bale is fed too rapidly, the delamination roller will clog, resulting in no delamination at all. Conversely, if the bale is fed too slowly, the tobacco will be torn, producing excessive fines and dust.

A second important factor is the action of the delamination knife. It has been found that using a spiked wheel, rather than the delamination knife, does not produce acceptable results. First, the tobacco is subjected to tearing action, rather than slicing, leading to the production of excessive fines. Second, the tobacco tends to wrap around the roller, rapidly clogging the system. Both of these adverse results are avoided by using the delamination knife.

Figure 4:
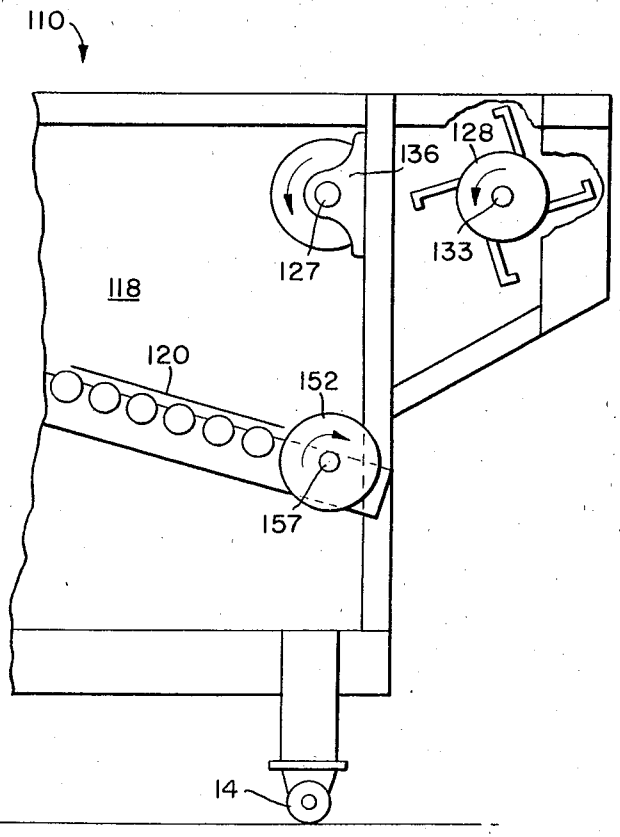
FIG. 4 is a partial side view of an alternate embodiment, with side plates and drive apparatus removed.

Variations are possible in the apparatus for gripping and feeding the bale. For example, FIG. 4 shows an alternate embodiment 110. Here, the delamination roller 128 is identical to that previously discussed, as is the feed roller 126. These rollers are positioned exactly as previously discussed, with the pressure roller shaft 127 journaled in blocks 136, and the delamination roller shaft 133 is journaled in the side plate of the delamination chamber. Instead of employing a pressure roller, however, there is provided a pinch roller 152, whose shaft 157 is journaled in horizontal frame members so that the upper surface of the pinch roller projects slightly above the floor 120 of the delamination chamber 118. The pinch roller is located directly beneath the feed roller, with the clearance between the two rollers being slightly less than twelve inches.

Figure 5:
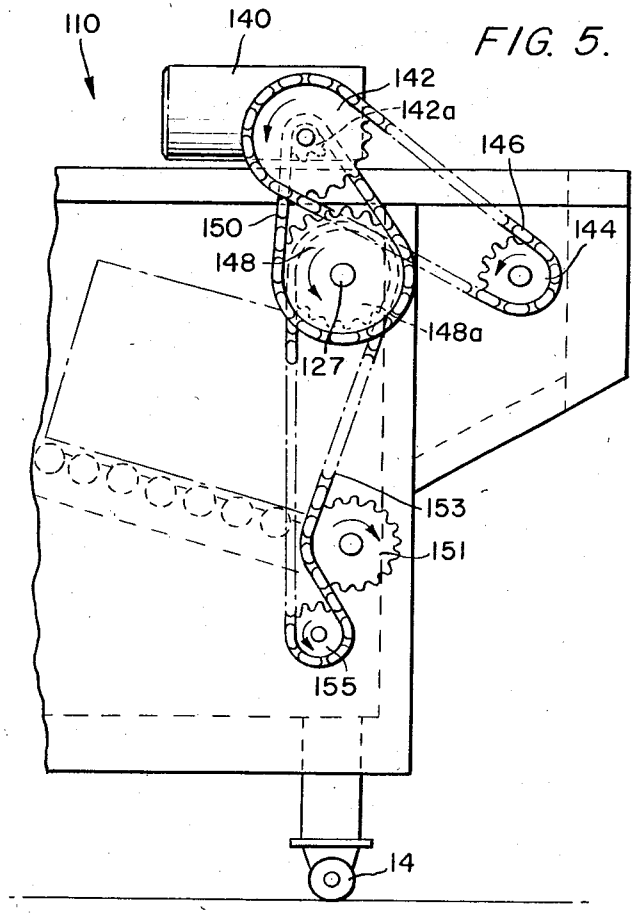
FIG. 5 is a partial side view of the embodiment shown in FIG. 4, with side plates and drive apparatus mounted.

Drive apparatus for this embodiment is shown in FIG. 5. As with the previous embodiment, motor 140 drives sprockets 142 and 142*a*. The delamination roller is driven by a chain 146, which engages motor sprocket 142 and delamination roller sprocket 144. The feed roller is driven by chain 150, which engages motor sprocket 142*a* and feed roller sprocket 148. Sprocket ratios are also identical: motor speed is chosen at 100 rpm, delamination roller speed is 200 rpm, and feed roller speed is 50 rpm.

The pinch roller is driven in a direction opposite to that of the feed roller by chain 153, which engages an idler sprocket 155 and a second feed roller sprocket 148*a*, fixed to feed roller shaft 127. The pinch roller chain passes over the face of the pinch roller sprocket, rather than around it, inducing contra rotation. Sprocket ratios are chosen such that the circumferential speed of the pinch roller is identical to that of the feed roller.

Operation of the this embodiment is similar to that of the previous embodiment, except that the bale is gripped and fed between the feed roller and the pinch roller rather than by the combined action of a pressure roller and feed roller. A gripping force, sufficient to hold the bale against the action of the delamination knife is provided by making the clearance between the feed roller and the pinch roller slightly less than the thickness of a bale.

Figure 6:
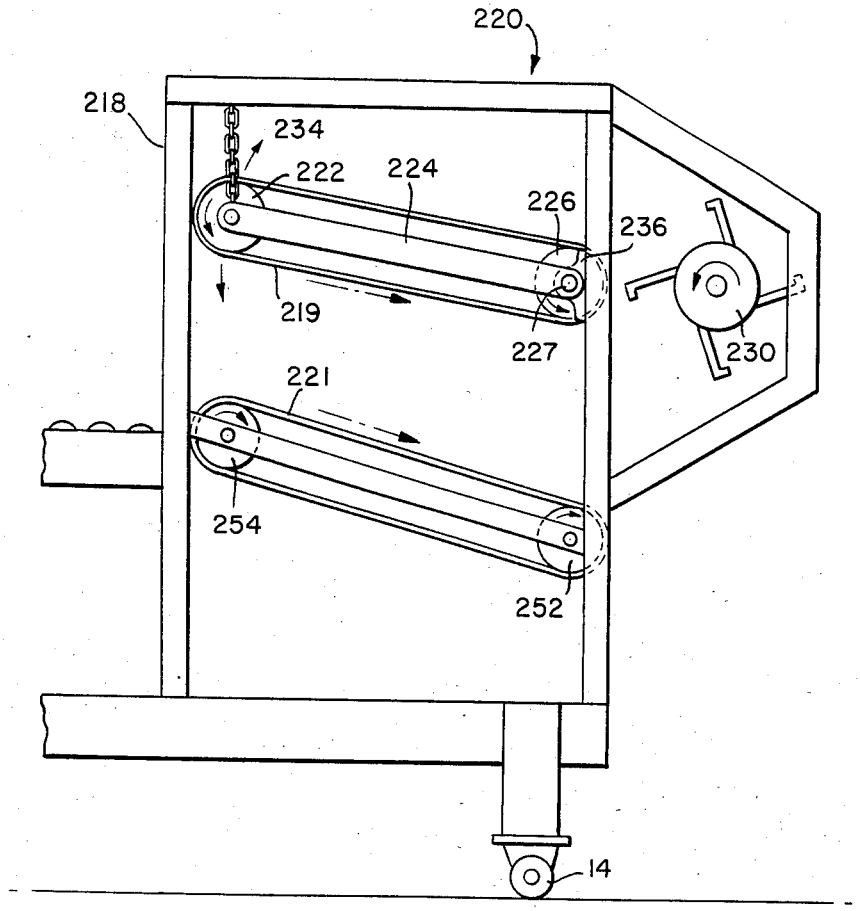
FIG. 6 is a partial side view of a further embodiment, with side plates and drive apparatus removed.

A further variation is seen in FIG. 6. Here, gripping and feeding action is provided by upper and lower belts 219 and 221, rather than by rollers. The lower belt is carried on a driven roller 252, journaled in horizontal frame members adjacent the output end of the delamination chamber 218, and an idler roller 254, journaled in horizontal frame members adjacent the input end of the chamber. These rollers are dimensioned and positioned so that the lower belt forms the floor of the delamination chamber.

The upper belt 219 is carried on a driven roller 226 and an idler roller 222. The driven roller shaft 227 is journaled in mounting blocks 236, carried on a vertical frame members at the output end of the delamination chamber. Pivoting linkage arms 224 each have one end also journaled on shaft 227. The other ends of the linkage arms carry idler roller 222. Limit chains 234 are attached to the upper horizontal frame members of the delamination chamber and to the linkage arms. Thus, the idler roller is free to move vertically, with its downward travel limited by the limit chains.

The delamination roller 230 is identical to that dislosed in previous embodiments. Also, the drive mechanism for this embodiment is identical to that employed in the embodiment shown in FIG. 5, with the lower belt driven roller 252 being driven in the manner shown in FIG. 5 for pinch roller 152.

The rollers are positioned so that the clearance between the upper and lower belts at the output end of the delamination chamber is slightly less than twelve inches. Limit chain 234 is dimensioned so that at the lower limit of travel of idler roller 222, the clearance between the upper and lower belts is about ten inches. Thus, as a bale enters the delamination chamber, the upper belt rides up on it, exerting a downward pressure to hold the bale in position as it is fed.

Delamination of a farmer's bale proceeds exactly as discussed in previous embodiments.

Other variations in the present invention will be apparent to those skilled in the art. Materials, dimensions, or positions for particular components may be selected to meet specific needs. Drive means may be adapted to available sources of shaft power. These and other variations may be made without departing from the spirit of the present invention, which is defined only by the claims attached hereto.

We claim:

1. Apparatus for delaminating farmer's bales of tobacco, comprising:

means for gripping and feeding a bale in a uniform and controlled manner at a selected rate; and means for slicing a bale into lamina of about a selected thickness, adjacent the output of said gripping and feeding means; wherein said slicing means includes a powered roller;

a plurality of pins arranged in a plurality of circumferentially spaced rows, projecting from said roller; and a plurality of delamination knives, each said knife being fixed to the projecting ends of one of said rows.

2. The delaminating apparatus of claim 1, further comprising:

timing means for maintaining the action of said gripping and feeding means in timed relationship with the action of said slicing means.

3. The delaminating apparatus of claim 1, wherein said gripping and feeding means includes at least one upper powered roller opposed to at least one pinch roller.

4. The delaminating apparatus of claim 1, wherein said gripping and feeding means includes upper and lower powered belts.

5. The delaminating apparatus of claim 1, wherein said pins are arranged in four of said rows.

6. The delaminating apparatus of claim 1, wherein said pins project from said roller such that the axis of each said pin is tangent to a circle coaxial to and having a smaller diameter than said roller.

7. The delaminating apparatus of claim 1 wherein each of said knives is constructed of angle iron having the projecting leg of the angle oriented in the direction of the rotation of said powered roller.

8. The delaminating apparatus of claim 1 wherein each of said knives describes a circular path when said roller is rotating.

9. A method for delaminating farmer's bales of tobacco, said method comprising the steps of:

feeding a stream of farmer's bales at a uniform, controlled, selected rate into an apparatus for delaminating farmer's bales; and slicing a selected portion of the leading edge of the foremost bale from the bale; and timing said slicing and said feeding steps to maintain a selected relationship between same.

10. The method of claim 9 wherein said method employs an apparatus for delaminating farmer's bales of tobacco comprising:

means for gripping and feeding a bale in a uniform and controlled manner at a selected rate; and means for slicing a bale into lamina of about a selected thickness, adjacent the output of said gripping and feeding means; wherein said slicing means includes:

a powered roller;

a plurality of pins arranged in a plurality of circumferentially spaced rows, projecting from said roller; and a plurality of delamination knives, each said knife being fixed to the projecting ends of one of said rows.

* * * * *